US009471039B2

(12) United States Patent
Kim

(10) Patent No.: US 9,471,039 B2
(45) Date of Patent: Oct. 18, 2016

(54) WATCH HAVING GEARS FOR OBSERVATION

(71) Applicant: Tae-Hyun Kim, Seoul (KR)

(72) Inventor: Tae-Hyun Kim, Seoul (KR)

(73) Assignee: Tae Hyun Kim, Seoul (KR)

( * ) Notice: Subject to any disclaimer, the term of this patent is extended or adjusted under 35 U.S.C. 154(b) by 0 days.

(21) Appl. No.: 14/411,117

(22) PCT Filed: Jun. 25, 2013

(86) PCT No.: PCT/KR2013/005572

§ 371 (c)(1),
(2) Date: Dec. 24, 2014

(87) PCT Pub. No.: WO2014/003398

PCT Pub. Date: Jan. 3, 2014

(65) Prior Publication Data

US 2015/0301504 A1 Oct. 22, 2015

(30) Foreign Application Priority Data

Jun. 26, 2012 (KR) ..... 10-2012-0068361

(51) Int. Cl.

| | |
|---|---|
| ***G04B 13/00*** | (2006.01) |
| ***G04B 19/00*** | (2006.01) |
| ***G04B 45/00*** | (2006.01) |
| ***G04B 45/02*** | (2006.01) |
| ***G04B 37/00*** | (2006.01) |
| ***G04B 19/04*** | (2006.01) |

(52) U.S. Cl.

CPC ..... *G04B 37/00* (2013.01); *G04B 13/00* (2013.01); *G04B 19/04* (2013.01); *G04B 45/02* (2013.01)

(58) Field of Classification Search

CPC ..... G04B 13/00; G04B 19/00; G04B 19/02; G04B 19/042; G04B 45/00; G04B 45/0061; G04B 45/02

See application file for complete search history.

(56) References Cited

U.S. PATENT DOCUMENTS 4,428,682 A * 1/1984 Winter ..... G04B 19/04 368/221
5,359,578 A * 10/1994 Truini ..... G04B 19/00 368/223

(Continued)

FOREIGN PATENT DOCUMENTS

JP 02-099886 A 4/1990
JP 07-244173 A 9/1995

(Continued)

OTHER PUBLICATIONS

International Search Report for PCT/KR2013/005572 mailed Jul. 29, 2013 from Korean Intellectual Property Office.

*Primary Examiner* — Vit W Miska
(74) *Attorney, Agent, or Firm* — Paratus Law Group, PLLC

(57) ABSTRACT

A watch having gears for observation, including: a watch body; a hand assembly having a second hand, a minute hand or an hour hand to be rotated at a surface of the watch body so as to display a time; gears for observation independently and rotatably provided at one end of the had assembly and to be rotated in a rotation process of the hand assembly; and a driving gear assembly provided at one side of the outside or the inside of the watch body and engaged with the gears for observation. The present invention can utilize the watch as a studying material through the gears for observation which are independently rotated according to the rotation of the hand assembly such as the second hand and the like.

10 Claims, 5 Drawing Sheets

(56) References Cited

U.S. PATENT DOCUMENTS 5,999,496 A * 12/1999 Chaut ..... G04B 19/082 368/223
7,061,833 B2 * 6/2006 Dierenbach ..... G04B 19/02 368/233
7,630,277 B2 * 12/2009 Conus ..... G04B 45/0015 368/220
2011/0051562 A1 3/2011 Blondeau et al.

FOREIGN PATENT DOCUMENTS

KR 10-0194757 2/1999
KR 20-0238416 Y1 10/2001
KR 10-0680163 2/2007
KR 10-2008-0063503 A 7/2008

* cited by examiner (a)

(b)

WATCH HAVING GEARS FOR OBSERVATION

CROSS REFERENCE TO PRIOR APPLICATION

This application is a National Stage Patent Application of PCT International Patent Application No. PCT/KR2013/005572 (filed on Jun. 25, 2013) under 35 U.S.C. §371, which claims priority to Korean Patent Application No. 10-2012-0068361 (filed on Jun. 26, 2012), which are all hereby incorporated by reference in their entirety.

TECHNICAL FIELD

The present invention relates to a watch, and more particularly, to a watch having gears for observation formed in an hour hand, a minute hand thereof, etc., thereby obtaining a visual effect and an educational effect through the rotation of the gears.

BACKGROUND ART

In elementary education curriculum and the secondary education curriculum, various kinds of lessens using a watch, such as a process of practicing reading time through an hour hand and a minute hand and a process of calculating an angle between the hour hand and the minute hand, are carried out.

Korean Patent Registration No. 0680163 discloses an education tool and an educating method for enabling a child to easily learn a method of reading a watch, and Korean Patent Registration No. 0194757 discloses a watch in which a protractor is used in order to calculate an angle between the hour hand and the minute hand or a protractor for indicating an angle is provided in the watch itself.

However, such related arts are limited to relatively simple contents such as the method of reading a watch or the calculating of the angle between the hour hand and the minute hand and are not further utilized in a scheme for learning complex mathematical calculations or concepts.

Thus, it is necessary that an education tool for education and an educating method using the same are carried out through more various schemes to enable a user to more easily approach educational content by using a watch which people can easily encounter and which is familiar.

DETAILED DESCRIPTION OF THE INVENTION

Technical Problem

The present invention is conceived to solve the above-mentioned problems in the related art, and an aspect of the present invention is to carry out more various kinds of education and learning functions through a watch.

Another aspect of the present invention is to allow gears, which are rotated separately with a second hand, a minute hand, etc., to serve as a decoration.

Technical Solution

In order to implement the above-described aspect, in accordance with the present invention, the present invention includes: a watch body; a hand assembly including one or more of a second hand, a minute hand, and an hour hand which are rotated on a surface of the watch body to display time; a gear for observation disposed on one end of the hand assembly to be rotated while the hand assembly is rotated; and a driving gear assembly that is disposed on one side of the outside or the inside of the watch body and enables the gear for observation to be rotated while being engaged with the gear for observation.

Further, the hand assembly includes: a second hand that is rotated about a central shaft and displays seconds; a minute hand that is rotated about the second hand equally to the second hand and displays minutes; and an hour hand that is rotated about the central shaft equally to the second hand and the minute hand and displays hours, and the hand assembly is rotated while interworking with the driving gear assembly disposed inside the watch body.

At this time, at least a part of the driving gear assembly is configured to have a ring gear form fixedly installed outside the watch body, and the gear for observation installed to be independently rotatable with the hand assembly is disposed at one end of at least one of the hand assembly, so as to be rotated according to rotation of the hand assembly while being engaged with the driving gear assembly.

Further, the driving gear assembly includes: a first gear part that is fixedly installed outside the watch body and has a ring gear form, gear teeth of which protrude toward the central shaft of the hand assembly; and a second gear part that is fixedly installed outside the watch body to be concentric to the first gear part and has a ring gear form, gear teeth of which protrude outward, and any one of the gear for observation is configured as an internal gear rotated while being in inner contact with the first gear part or an external gear rotated while being in outer contact with the second gear part.

Meanwhile, the driving gear assembly includes a central gear part fixedly installed at the center of the watch body, and any one of the gear for observation is rotated while being in outer contact with the central gear part.

Further, the gears for observation are replaceable and engaged with the hand assembly, the hand assembly has a plurality of engaging holes formed therein for engaging with the gear for observation along a lengthwise direction thereof, and thus, gears for observation having different diameters are selectively engaged with hand assemblies.

Further, the number of gear teeth of the gear for observation is displayed on an outer surface of the gear for observation, the number of gear teeth of the driving gear assembly is displayed on an upper surface of the watch body, and at least one of a time display part for displaying time and an angle display part for displaying an angle is displayed on the upper surface of the watch body.

In addition, the gear for observation includes: a first gear for observation that is rotatably disposed at one end of the second hand and is rotated while being in outer contact with the second gear part of the driving gear assembly; a second gear for observation that is rotatably disposed at one end of the minute hand and is rotated while being in inner contact with the first gear part of the driving gear assembly; and a third gear for observation that is rotatably disposed at one end of the hour hand and is rotated while being in outer contact with the central gear part fixedly installed to be concentric to the central shaft of the hour hand.

Further, a drawing pen, which leaves rotation trajectory of the gear for observation on the upper surface of the watch body and protrudes toward the upper surface of the watch body, is disposed in the gear for observation.

Meanwhile, the gear for observation is engaged with the hand assembly to move in a direction in which the gear for observation becomes closer to the watch body, a resilient member is disposed between the gear for observation and the hand assembly to provide a resilient force to the gear for observation toward the upper surface of the watch body, and when the drawing pen is worn, the gear for observation is lowered toward the upper surface of the watch body.

Furthermore, the gear for observation is engaged with the hand assembly by a wedge piece, and the resilient member is disposed at one end of the wedge piece.

Advantageous Effects

The above-described watch having gears for observation according to the present invention has the following effects.

The present invention can utilize a watch as a studying material through gears for observation which are rotated according to rotation of a hand assembly such as a second hand and independently with the same.

In particular, various kinds of learning can be carried out by a scheme of predicting the number of revolutions of the gears for observation through the number of gear teeth of the gears for observation and the number of gear teeth of a driving gear assembly engaged therewith, or in contrast, predicting the number of teeth through the number of revolutions. Further, more diverse examples can be implemented by exchanging the gears for observation and the driving gear assembly.

Further, the present invention can improve a decorative function of a watch by rotation of the gears for observation which are rotated independently with the hand assembly.

BEST MODE FOR CARRYING OUT THE INVENTION

Figure 1:
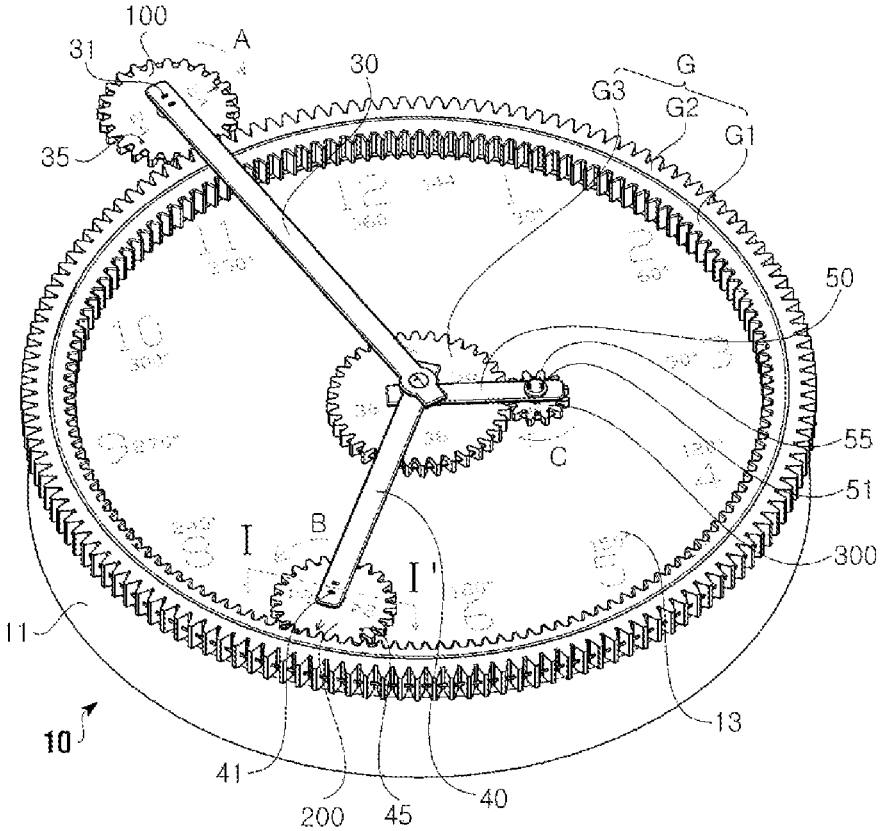
FIG. 1 is a perspective view illustrating a preferred embodiment of a watch having gears for observation according to the present invention.

The present invention relates to a watch having gears for observation, the watch including: a watch body; a hand assembly including one or more of a second hand, a minute hand, and an hour hand which are rotated on a surface of the watch body to display time; a gear for observation disposed at one end of the hand assembly to be rotated while the hand assembly is rotated; and a driving gear assembly that is disposed on one side of the outside or the inside of the watch body and enables the gear for observation to be rotated while being engaged with the gear for observation.

Further, the hand assembly includes: a second hand that is rotated about a central shaft and displays seconds; a minute hand that is rotated about the second hand equally to the second hand and displays minutes; and an hour hand that is rotated about the central shaft equally to the second hand and the minute hand and displays hours, and the hand assembly is rotated while interworking with the driving gear assembly disposed inside the watch body.

Further, at least a part of the driving gear assembly is configured to have a ring gear form fixedly installed at the outside of the watch body, and the gear for observation installed to be independently rotatable with the hand assembly is disposed at one end of at least one of the hand assembly, so as to be rotated according to the rotation of the hand assembly while being engaged with the driving gear assembly.

At this time, the driving gear assembly includes: a first gear part that is fixedly installed outside the watch body and has a ring gear form, gear teeth of which protrude toward the central shaft of the hand assembly; and a second gear part that is fixedly installed outside the watch body to be concentric to the first gear part and has a ring gear form, gear teeth of which protrude outward, and any one gear for observation is configured as an internal gear rotated while being in inner contact with the first gear part or an external gear rotated while being in outer contact with the second gear part.

Further, the driving gear assembly includes a central gear part fixedly installed at a center of the watch body, and any one gear for observation is rotated while being in outer contact with the central gear part.

In addition, the gear for observation includes: a first gear for observation that is rotatably disposed at one end of the second hand and is rotated while being in outer contact with the second gear part of the driving gear assembly; a second gear for observation that is rotatably disposed at one end of the minute hand and is rotated while being in inner contact with the first gear part of the driving gear assembly; and a third gear for observation that is rotatably disposed at one end of the hour hand and is rotated while being in outer contact with the central gear part fixedly installed to be concentric to the central shaft of the hour hand.

MODE FOR CARRYING OUT THE INVENTION

Hereinafter, detailed embodiments of a watch having gears for observation and an educating method using the same according to the present invention will be described in detail with reference to the accompanying drawings.

Figure 2:
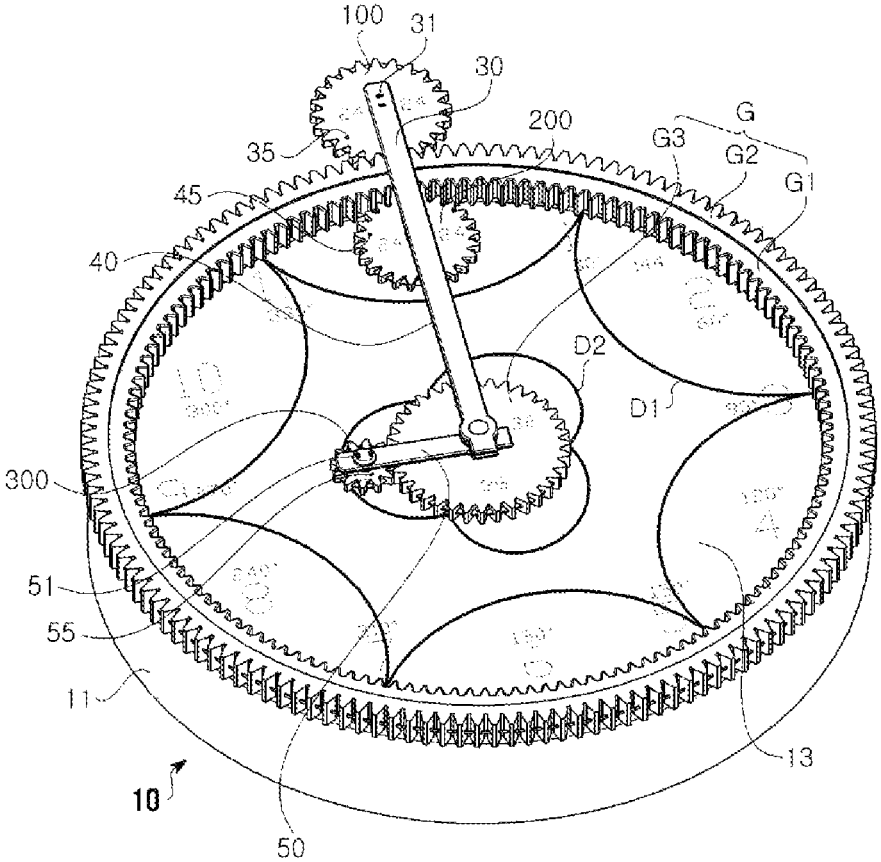
FIG. 2 is a perspective view illustrating a configuration of an embodiment of the present invention.

FIG. 1 is a perspective view illustrating a configuration of a preferred embodiment of a watch having gears for observation, and FIG. 2 is a perspective view illustrating a configuration of an embodiment of the present invention.

As illustrated in these figures, an outer appearance and framework of a watch 10 having gears for observation according to the present invention are formed by a watch body 11. The watch body 11 is formed by a solid material of an approximately circular plate shape as illustrated in FIG. 1, and an operating assembly 500 which will be described below is disposed on the inside thereof, thereby enabling an overall operation of a watch. Of course, the shape of the watch body 11 is not necessarily limited to a circular plate shape, and may have various other shapes.

Hand assemblies 30, 40, and 50 are disposed in the watch body 11. The hand assemblies 30, 40, and 50 include one or more of a second hand 30, a minute hand 40, and an hour hand 50 which are rotated on a surface of the watch body 11 to display the time. In the present embodiment, all of the second hand 30, the minute hand 40, and the hour hand 50 are provided.

The hand assemblies 30, 40, and 50 are rotated about a central shaft S (see FIG. 5) while the second hand 30, the minute hand 40, and the hour hand 50 interlock with each other by the operating assembly 500. More precisely, the hand assemblies 30, 40, and 50 include the second hand 30 which is rotated about the central shaft S and displays seconds, the minute hand 40 which is rotated about the central shaft S, identically to the second hand 30, and displays minutes, and the hour hand 50 which is rotated about the central shaft S, identically to the second hand 30 and the minute hand 40, and displays hours.

Figure 5:
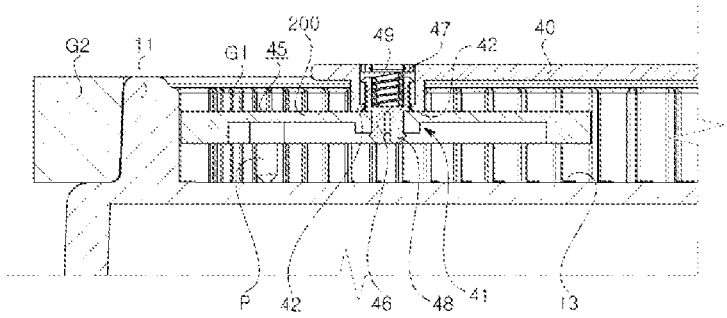
FIG. 5 is an operating state diagram illustrating a process in which a hand assembly is operated according to wear of a drawing pen.
Figure 5:
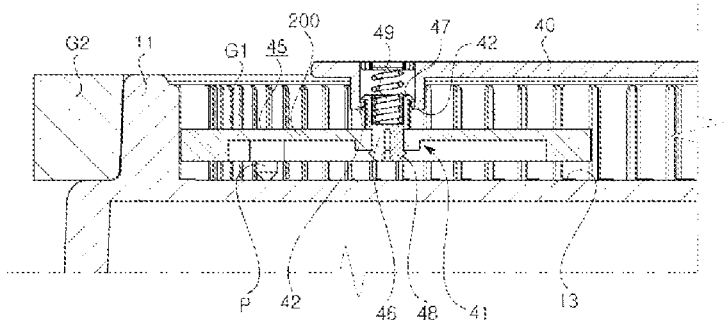

The hand assemblies 30, 40, and 50 include drawing pens P (see FIG. 5). The drawing pens P are for leaving rotation trajectories of gears 100, 200, and 300 for observation on a drawing panel 13 disposed on the upper surface of the watch body 11 while the gears 100, 200, and 300 for observation, which will be described below, are rotated. In the present embodiment, the drawing pens P are disposed on the gears 100, 200, and 300 for observation coupled to the hand assemblies 30, 40, and 50, respectively.

At least one of time display parts for displaying time and angle display parts for displaying an angle are displayed on the upper surface of the watch body 11. That is, as illustrated in FIG. 1, the time display parts for displaying time are displayed on the drawing panel 13 disposed on the upper surface of the watch body 11 in order of 1, 2, 3, . . . in the clockwise direction with respect to 12 o'clock, and in addition, the angle display parts for displaying an angle are displayed in a sequential order of 30°, 60°, and the like, in the clockwise direction with respect to 360°.

The watch body 11 includes a driving gear assembly G. The driving gear assembly G is disposed on one side of the outside and the inside of the watch body 11, is engaged with the gears 100, 200, and 300 for observation, and is fixed to the watch body 11 without rotating.

In the present embodiment, the driving gear assembly G includes a first gear part G1, a second gear part G2, and a central gear part G3. The first gear part G1 is fixedly installed outside the watch body 11, and has a ring gear form in which gear teeth thereof protrude toward the central shaft S of the hand assemblies 30, 40, and 50, and the second gear part G2 is fixedly installed outside the watch body 11 to be concentric to the first gear part G1, and has a ring gear form in which gear teeth thereof protrude outward.

That is, the first gear part G1 and the second gear part G2 are disposed to be in contact with each other, the first gear part G1 has the gear teeth protruding inward, and the second gear part G2 has the gear teeth protruding outward. The first gear part G1 and the second gear part G2 are in outer contact with and in inner contact with the first gear 100 for observation and the second gear 200 for observation, which will be described below, respectively.

Further, the central gear part G3 is fixedly installed at the central portion of the watch body 11, is in outer contact with a third gear 300 for observation among the gears 100, 200, and 300 for observation, and is rotated. As illustrated in FIG. 1, the central gear part G3 is provided to configure a rotational center of the hand assemblies 30, 40, and 50 as a center thereof.

Consequently, such a driving gear assembly G is engaged with the gears 100, 200, and 300 for observation in a fixed state to rotate the gears 100, 200, and 300 for observation, and is preferably formed to have gear teeth corresponding to the gears 100, 200, and 300 for observation.

Of course, the driving gear assembly G may be provided in the watch body 11 to be replaceable. That is, the driving gear assembly G may be replaced to have various numbers of gear teeth according to selection of a user.

The gears 100, 200, and 300 for observation are provided in the hand assemblies 30, 40, and 50. The gears 100, 200, and 300 for observation are independently and rotatably disposed at ends of the hand assemblies 30, 40, and 50, are rotated together while the hand assemblies 30, 40, and 50 are rotated, and are configured by gears having a circular plate shape as illustrated in FIG. 1.

More precisely, the gears 100, 200, and 300 for observation are rotatably disposed at ends of the hand assemblies 30, 40, and 50 while having a rotation axis which is parallel with a rotation axis of the hand assemblies 30, 40, and 50. Such engaging between the gears 100, 200, and 300 for observation and the hand assemblies 10, 20, and 30 are made by engaging assemblies 31, 41, and 51. The description relating thereto will be made with reference to FIG. 5A. For reference, the engaging between the first gear 100 for observation, the second gear 200 for observation, and the third gear 300 for observation among the gears 100, 200, and 300 for observation and the hand assemblies 30, 40, and 50 are equally made by the engaging assemblies 31, 41, and 51, respectively. Thus, hereinafter, the description will be made on the basis of the engaging between the second gear 200 for observation and the minute hand 40.

FIG. 5A is a sectional view taken along line I-I' in FIG. 1. As illustrated, an engaging hole (not designated by reference numeral) is formed at one end of the minute hand 40, and a fastening hole (not designated by reference numeral) corresponding thereto is formed at the second gear 200 for observation. A wedge piece 46 passes through the engaging hole and the fastening hole, thereby making the engaging therebetween. As illustrated, the wedge piece 46 has a resilient piece 48 at one end thereof. The wedge piece 46 passes through the fastening hole of the gear 200 for observation and is then restored to its original form through elastic deformation, so as to allow the second gear 200 for observation to the minute hand 40.

At this time, a catching end 47 is provided on the wedge piece 46, and a hanging end 42 is provided at the engaging hole of the minute hand 40 corresponding thereto, so that the wedge piece 46 is prevented from being separated downward, and an elevation range of the wedge piece 46 is limited.

Resilient members 49 are provided at the engaging assemblies 31, 41, and 51. One of the resilient members 49 is provided between the second gear 200 for observation and the minute hand 40, thereby providing a resilient force to the second gear 200 for observation toward the upper surface of the watch body 11. This is for maintaining a folded state without being spaced apart from the drawing pen P and the drawing panel 13 disposed on the upper surface of the watch body 11 even when the drawing pen P is worn during a drawing process.

Such engaging assemblies 31, 41, and 51 can be equally applied to the first gear 100 for observation and the third gear 300 for observation as well as the second gear 200 for observation.

The gears 100, 200, and 300 for observation are rotatably engaged with the hand assemblies 30, 40, and 50, so as to be rotated while being engaged with the driving gear assembly G during a rotation process of the hand assemblies 30, 40, and 50. Accordingly, a scheme of operating the gears can be observed and a decorative function of a watch can be added through the gears 100, 200, and 300 for observation rotated with an operation of the watch.

In addition, the gears 100, 200, and 300 for observation are rotated while being engaged with the driving gear assembly G, so that the number of revolutions can be predicted through the numbers of gear teeth of the gears 100, 200, and 300 for observation and the driving gear assembly G, and a studying function can be implemented therethough.

In particular, the gears 100, 200, and 300 for observation can be replaced by the engaging assemblies 31, 41, and 51, and thus is replaced by gears 100, 200, and 300 for observation having various diameters and various numbers of gear teeth, thereby adjusting the number of revolutions and implementing a studying function therethrough. For example, In FIGS. 1 and 2, the gear 100 for observation has 24 gear teeth and the second gear part G2 of the driving gear assembly G has 144 gear teeth, so that the first gear 100 for observation is rotated six times in one hour (24*6=144). However, as in FIG. 3, when the first gear 100 for observation has 36 gear teeth, for one hour, the first gear 100 for observation is rotated four times in one hour (36*4=144).

Further, a display part (not designated by a reference numeral) for displaying the number of gear teeth may be formed on the outer surface of the gears 100, 200, and 300 for observation, and in addition, an arrow for displaying directions of the gears 100, 200, and 300 for observation may be represented.

At this time, although not illustrated, a plurality of engaging holes, which are formed on the hand assemblies 30, 40, and 50 to implement engaging with the gears 100, 200, and 300 for observation, are formed along the lengthwise directions of the hand assemblies 30, 40, and 50, so that the gears 100, 200, and 300 for observation having different diameters are selectively engaged with the hand assemblies 30, 40, and 50.

Drawing pens P are provided on the gears 100, 200, and 300 for observation. The description will be made on the basis of the second gear 200 for observation constituting the gears 100, 200, and 300 for observation. A pen hole 45 is formed on the second gear 200 for observation, and the drawing pen P is inserted into the pen hole 45. The pen hole is formed by being penetrated, and thus, the drawing pen P can be replaced when being worn through the penetration.

Figure 4:
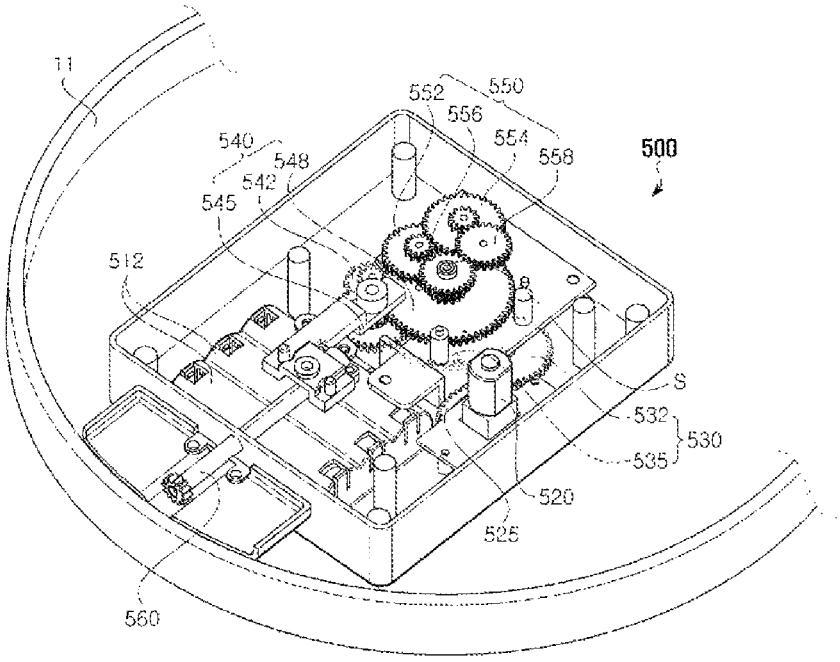
FIG. 4 is a perspective view illustrating an internal configuration of a watch body constituting an embodiment of the present invention.

Next, an operating assembly 500 provided inside the watch body will be described with reference to FIG. 4.

The operating assembly 500 is provided inside the watch body 11, and a power insertion part 512 is included in the operating assembly 500. The power insertion part 512 corresponds to a space into which a power source such as a battery is inserted.

Further, the operating assembly includes a second hand driving part 530, a minute hand driving part 540, and an hour hand driving part 550. The second hand driving part 530 is for rotating the second hand 30, and is configured by a plurality of gears connected to a driving gear 525 rotated by a driving motor 520 connected to the power insertion part 512.

The second hand driving part 530 interworks with the minute hand driving part 540 so as to operate the minute hand driving part 540, and the minute hand driving part 540 interworks with the hour hand driving part 550 again so as to operate the hour hand driving part 550. More precisely, when the second hand 30 is rotated about the central shaft S by the second hand driving part 530 by 60 revolutions, the minute hand driving part 540 allows the minute hand 40 to be rotated by one revolution, and when the minute hand 40 is rotated by 12 revolutions, the hour hand driving part 550 allows the hour hand 50 to be rotated by one revolution.

At this time, all of the second hand driving part 530, the minute hand driving part 540, and the hour hand driving part 550 are configured by a plurality of gears, and one of the gears of the second hand driving part 530 is a gear for rotating the central shaft S connected to the second hand 30. Not-described reference numeral 560 is a crown of the watch for adjusting time.

Hereinafter, an operation of a watch having gears for observation according to the present invention will be described in detail with reference to the accompanying drawings.

First, a process of rotating the gears 100, 200, and 300 for observation and the hand assemblies 30, 40, and 50 of the watch 10 having gears for observation according to the present invention will be described.

The second hand 30 of the hand assemblies 30, 40, and 50 is rotated by the operating assembly 500 constituting the watch 10 having gears for observation, and the minute hand 40 and the hour hand 50 are rotated while interworking with the second hand 30. At this time, the second hand 30, the minute hand 40, and the hour hand 50 are rotated together using the central shaft S provided at the center of the watch body 11 as a rotation shaft.

At this time, the gear 100 for observation corresponding to one of the gears 100, 200, and 300 for observation is rotatably disposed at one end of the second hand 30, and the first gear 100 for observation is engaged with the second gear part G2 constituting the driving gear assembly G, so as to be rotated in direction A of FIG. 1 while being engaged with the second gear part G2 as the second hand 30 is rotated. That is, the first gear 100 for observation is rotated while being in outer contact with the second gear part G2.

Meanwhile, the second gear 200 for observation is rotatably disposed at one end of the minute hand 40, and the second gear 200 for observation is engaged with the first gear part G1 constituting the driving gear assembly G to be in inner contact with the first gear part G1, so as to be rotated in direction B of FIG. 1 while being engaged with the first gear part G1 as the minute hand 40 is rotated.

Further, the third gear 300 for observation is rotatably disposed at one end of the hour hand 50, and the third gear 300 for observation is engaged with the central gear part G3 constituting the driving gear assembly G to be in outer contact with the central gear part G3, so as to be rotated in direction C of FIG. 1 while being engaged with the central gear part G3 as the hour hand 50 is rotated.

Further, a user observes such rotations of the gears 100, 200, and 300 for observation, thereby predicting the number of gear teeth or predicting the number of revolutions from the number of gear teeth of the gears 100, 200, and 300 for observation.

Further, such number of revolutions can be accurately identified by the drawing pen P with the naked eye. That is, the drawing pen P is provided in the gears 100, 200, and 300 for observation to leave a rotation trajectory on the drawing panel 13 on the upper surface of the watch body 11, so that a user can identify the number of revolutions of the gears 100, 200, and 300 for observation by observing the trajectory generated by the drawing pen P.

For reference, in FIG. 2, the third gear 300 for observation has 12 gear teeth, so that the third gear 300 for observation is rotated around the central gear part G3 having 36 gear teeth by three revolutions while the hour hand 50 is rotated by 360 degrees (for 12 hours). In contrast, in FIG. 3, the third gear 300 for observation has 18 gear teeth, so that the third gear 300 for observation is rotated around the central gear part G3 having 36 gear teeth by two revolutions while the hour hand 50 is rotated by 360 degrees (for 12 hours).

Figure 3:
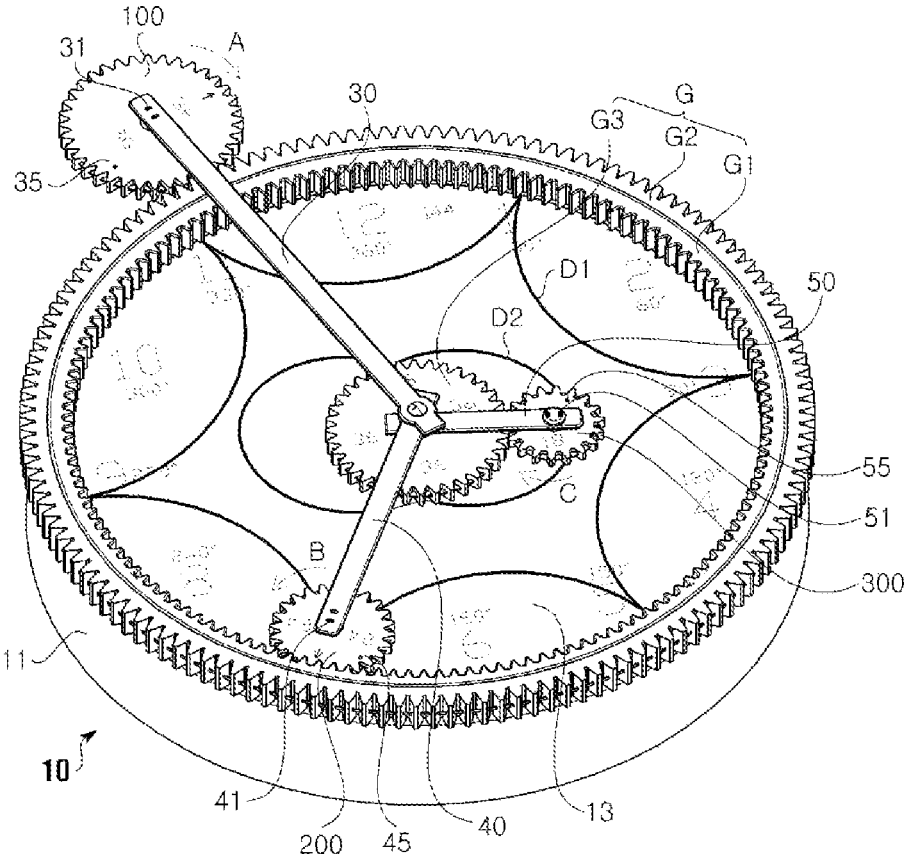
FIG. 3 is a perspective view illustrating an image in which a gear for observation constituting an embodiment of the present invention is replaced.

Further, trajectories drawn by the drawing pen P provided in the third gear 300 for observation are represented in FIGS. 2 and 3, respectively. Such trajectories, which are trajectories between gears having outer surfaces in contact with each other, become the Epi-Cycloid.

Meanwhile, the second gear 200 for observation is rotated while being engaged with and being in inner contact with the first gear part G1. In the present embodiment, the first gear part G1 has 144 gear teeth, and the second gear 200 for observation has 24 gear teeth, so that the second gear 200 for observation is rotated by six revolutions while the minute hand 40 is rotated by 360 degrees (for one hour).

Further, the trajectory for the six revolutions is left on the drawing panel 13 by the drawing pen P, and such a trajectory is illustrated in FIGS. 2 and 3. As illustrated, the trajectory becomes the hypo-cycloid which is a trajectory between gears in inner contact with each other.

At this time, when the drawing pen P is worn, as described above, the resilient member 49 provided in the engaging assemblies 31, 41, and 51 presses the wedge piece 46 to push the third gear 300 for observation toward the drawing panel 13, so that a trajectory can be left continuously even when the drawing pen P is worn. Of course, when the drawing pen P is worn by a predetermined level so as to be shortened, the drawing pen P can be replaced through pen holes 45 and 55.

Further, when a trajectory is drawn on the drawing panel 13 by the drawing pen P, a user can replace the drawing panel 13 as needed. The replacement of the drawing panel 13 is performed after the gears 100, 200, and 300 for observation and the hand assemblies 30, 40, and 50 are separated.

In this way, a user can recognize the operation of gears by observing the rotation of the gears through the watch 10 having gears for observation according to the present invention, and further, such gears are rotated while being exposed to the outside, so as to also perform a decorative function.

Further, the present invention can also perform a mathematical study function using a method of predicting the number of revolutions from the gear teeth of the gears 100, 200, and 300 for observation and the gear teeth of the driving gear assembly G or predicting the number of gear teeth through the number of revolutions. In particular, since the gears 100, 200, and 300 for observation and the driving gear assembly G can be replaced, it is possible to implement more diverse examples.

The protection scope of the present invention is not limited to the above-described embodiments, and is defined by claims. It is obvious that a person skilled in the art can diversely modify and remake the present invention without departing from the scope.

For example, in the above embodiment, the hand assemblies 30, 40, and 50 include the second hand 30, the minute hand 40, and the hour hand 50. However, the hand assemblies 30, 40, and 50 may include a part of the second hand 30, the minute hand 40, and the hour hand 50.

Further, in the above embodiment, among the gears 100, 200, and 300 for observation, the first gear 100 for observation is rotated while being in outer contact with the second gear part G2, and the second gear 200 for observation is rotated while being in inner contact with the first gear part G1. However, the first gear 100 for observation may be in inner contact with the second gear part G2, and the second gear 200 for observation is in outer contact with the first gear part G1. Further, all of the first gear 100 for observation and the second gear 200 for observation may be in inner or outer contact with the driving gear assembly G.

Industrial Applicability

The present invention relates to a watch having gears for observation, and the watch can be advantageously utilized as a study material through the gears for observation which are rotated according to the rotation of the hand assembly and independently thereto.

The invention claimed is:

1. A watch having gears for observation, the watch comprising:

a watch body;

a hand assembly including one or more of a second hand, a minute hand, and an hour hand which are rotated on a surface of the watch body to display time;

a gear for observation disposed at one end of the hand assembly to be rotated while the hand assembly is rotated; and a driving gear assembly that is disposed on one side of an outside or an inside of the watch body and enables the gear for observation to be rotated while being engaged with the gear for observation, wherein the hand assembly includes:

a second hand that is rotated about a central shaft and displays seconds;

a minute hand that is rotated about the second hand equally to the second hand and displays minutes; and an hour hand that is rotated about the central shaft equally to the second hand and the minute hand and displays hours, and the hand assemblies are rotated while interworking with the driving gear assemblies disposed inside the watch body, wherein a part of the driving gear assembly is configured to have a ring gear form fixedly installed outside the watch body, and the gear for observation installed to be independently rotatable with the hand assembly is disposed at one of at least one of the hand assembly, so as to be rotated according to rotation of the hand assembly while being engaged with the driving gear assembly.

2. A watch having gears for observation, the watch comprising:

a watch body;

a hand assembly including one or more of a second hand, a minute hand, and an hour hand which are rotated on a surface of the watch body to display time;

a gear for observation disposed at one end of the hand assembly to be rotated while the hand assembly is rotated; and a driving gear assembly that is disposed on one side of an outside or an inside of the watch body and enables the gear for observation to be rotated while being engaged with the gear for observation, wherein the hand assembly includes:

a first gear part that is fixedly installed outside the watch body and has a ring gear form, gear teeth of which protrude toward the central shaft of the hand assemblies; and a second gear part that is fixedly installed outside the watch body to be concentric to the first gear part and has a ring gear form, gear teeth of which protrude outward, and any one of the gear for observation is configured as an internal gear rotated while being in inner contact with the first gear part or an external gear rotated while being in outer contact with the second gear part.

3. The watch of claim 2, wherein the driving gear assembly includes a central gear part fixedly installed in a center of the watch body, and any one of the gear for observation is rotated while being in outer contact with the central gear part.

4. The watch of claim 3, wherein the gear for observation is replaceably engaged with the hand assembly, the hand assembly has a plurality of engaging holes formed therein for engaging with the gear for observation along a lengthwise direction thereof, and thus, gears for observation having different diameters are selectively engaged with the hand assembly.

5. The watch of claim 4, wherein a number of gear teeth of the gear for observation is displayed on an outer surface of the gear for observation, and a number of gear teeth of the driving gear assembly is displayed on an upper surface of the watch body.

6. The watch of claim 5, wherein at least one of a time display part for displaying time and an angle display part for displaying an angle is displayed on the upper surface of the watch body.

7. The watch of claim 6, wherein the gear for observation includes:

a first gear for observation that is rotatably disposed at one end of the second hand and is rotated while being in outer contact with the second gear part of the driving gear assembly;

a second gear for observation that is rotatably disposed at one end of the minute hand and is rotated while being in inner contact with the first gear part of the driving gear assembly; and a third gear for observation that is rotatably disposed at one end of the hour hand and is rotated while being in outer contact with the central gear part fixedly installed to be concentric to the central shaft of the hour hand.

8. The watch of claim 7, wherein a drawing pen, which leaves a rotation trajectory of the gear for observation on the upper surface of the watch body and protrudes toward the upper surface of the watch body, is disposed in the gear for observation.

9. The watch of claim 8, wherein the gear for observation is engaged with the hand assembly to move in a direction in which the gear for observation becomes closer to the watch body, a resilient member is disposed between the gear for observation and the hand assembly to provide a resilient force to the gear for observation toward the upper surface of the watch body, and when the drawing pen is worn, the gear for observation is lowered toward the upper surface of the watch body.

10. The watch of claim 9, wherein the gear for observation is engaged with the hand assembly by a wedge piece, and the resilient member is disposed at one end of the wedge piece.

* * * * *